US010072472B2

(12) United States Patent
Jensen

(10) Patent No.: US 10,072,472 B2
(45) Date of Patent: Sep. 11, 2018

(54) APPARATUS, SYSTEM, AND METHODS FOR DOWNHOLE DEBRIS COLLECTION

(71) Applicant: Schlumberger Technology Corporation, Sugar Land, TX (US)

(72) Inventor: Michael Jensen, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 256 days.

(21) Appl. No.: 14/728,455

(22) Filed: Jun. 2, 2015

(65) Prior Publication Data

US 2015/0345276 A1 Dec. 3, 2015

Related U.S. Application Data

(60) Provisional application No. 62/007,305, filed on Jun. 3, 2014.

(51) Int. Cl.
*E21B 27/00* (2006.01)
*E21B 43/12* (2006.01)
*E21B 43/38* (2006.01)

(52) U.S. Cl.
CPC ..... *E21B 27/00* (2013.01)

(58) Field of Classification Search
CPC ..... E21B 37/00; E21B 27/00; E21B 27/005; E21B 31/03
See application file for complete search history.

(56) References Cited

U.S. PATENT DOCUMENTS

| | | | | |
|---|---|---|---|---|
| 5,402,850 | A | 4/1995 | Lalande et al. | |
| 6,189,617 | B1 | 2/2001 | Sorhus et al. | |
| 6,427,776 | B1 * | 8/2002 | Hoffman | E21B 23/04 166/167 |
| 7,610,957 | B2 | 11/2009 | Davis et al. | |
| 8,162,064 | B1 * | 4/2012 | Penisson | E21B 27/00 166/335 |
| 2008/0053651 | A1 | 3/2008 | Hern et al. | |
| 2010/0243258 | A1 | 9/2010 | Fishbeck et al. | |
| 2010/0258297 | A1 | 10/2010 | Lynde et al. | |
| 2010/0288492 | A1 * | 11/2010 | Blackman | E21B 27/005 166/250.01 |
| 2011/0024119 | A1 | 2/2011 | Wolf et al. | |
| 2012/0061073 | A1 * | 3/2012 | Soni | E21B 27/04 166/99 |

(Continued)

FOREIGN PATENT DOCUMENTS

| | | | |
|---|---|---|---|
| WO | 2009140005 | A1 | 11/2009 |
| WO | W02011091165 | A2 | 7/2011 |

OTHER PUBLICATIONS

International preliminary report on patentability issued in the related PCT Application PCT/US2015/033947, dated Dec. 6, 2016, (8 pages).

(Continued)

*Primary Examiner* — Daniel P Stephenson
(74) *Attorney, Agent, or Firm* — Eileen Pape

(57) ABSTRACT

An apparatus for debris removal. The apparatus includes a debris storage housing. The debris storage housing has a velocity tube located therein. The velocity tube has a hole formed therethrough. A diverter is located on the velocity tube adjacent the hole.

20 Claims, 4 Drawing Sheets

(56) References Cited

U.S. PATENT DOCUMENTS

| | | | | |
|---|---|---|---|---|
| 2012/0273278 | A1* | 11/2012 | Zhu | E21B 37/00 175/206 |
| 2015/0083392 | A1* | 3/2015 | Stowe | E21B 31/00 166/99 |
| 2015/0226036 | A1* | 8/2015 | Wolf | E21B 23/00 166/311 |
| 2015/0345276 | A1* | 12/2015 | Jensen | E21B 27/00 166/265 |

OTHER PUBLICATIONS

International Search Report for corresponding International App No. PCT/US2015/033947, dated Aug. 24, 2015, 3 pages.
Written Opinion for corresponding International App No. PCT/US2015/033947, dated Aug. 24, 2015, 7 pages.
Extended Search Report issued in the related EP Application 15803834.9, dated Oct. 20, 2017 (6 pages).

* cited by examiner

APPARATUS, SYSTEM, AND METHODS FOR DOWNHOLE DEBRIS COLLECTION

CROSS-REFERENCE TO RELATED APPLICATIONS

This application claims benefit of U.S. Provisional Patent Application Ser. No. 62/007,305, filed Jun. 3, 2014, which is herein incorporated by reference.

FIELD OF THE DISCLOSURE

The disclosure generally relates to apparatus, systems, and methods for debris collection.

BACKGROUND

Often it is desirable to remove debris from wells including vertical wells, horizontal wells, and deviated wells. The debris is often removed using circulating fluid and a suction tool. The suction tools can clog with stored debris when the orientation of the tool is changed, fluid circulation is stopped, or fluid circulation is reversed.

SUMMARY

An embodiment of an apparatus for debris collection can have a debris storage section. A velocity tube is located in the debris storage section. The velocity tube has a hole formed therethrough. A diverter is located on the velocity tube adjacent the hole.

An example method of debris collection includes fluidizing debris in a wellbore. The method also includes flowing the fluidized fluid through a velocity tube. The method also includes discharging the fluidized debris to a storage space formed between the velocity tube and a storage housing. The discharging is through a hole formed in the velocity tube, an outlet of the velocity tube, or combinations thereof. The method also includes preventing discharged solids in the storage space from entering the velocity tube via the hole formed in the velocity tube.

An example system for debris collection includes a power section. The power section is connected with a pump section. A debris storage section is connected with the pump section. The debris storage section includes a velocity tube located therein. A hole is formed through the velocity tube, and a diverter section is located on the velocity tube adjacent the hole.

DETAILED DESCRIPTION OF THE INVENTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

An example apparatus for debris collection can include a debris storage housing. The debris storage housing can have a velocity tube located therein. The velocity tube can have any number of holes formed therein. Diverters can be located on the velocity tube and adjacent the holes.

The apparatus can be incorporated into a system for debris collection. The system for debris collection can include a debris storage section. The debris storage section can include the debris storage housing. The debris storage section can also include threaded connection ends and other downhole equipment. The threaded connections can be formed on the end of the debris storage housing or connected with the end of the debris storage housing.

The debris storage section can be connected with a pump section. The pump section can include a pump section housing, threaded connections, a pump, and other downhole equipment. The pump section housing can have one or more discharge ports located therein for discharging fluid therefrom.

The debris storage section can be connected with a power section. The power section can include a power section housing, threaded connections, electronic components, and other downhole equipment. The power section can include a processor located therein. The processor can be in communication with one or more sensors in the pump section and can receive data related to the pump section. The processor, in one or more embodiments, can use the data to detect when all the debris is collected. For example, the data can relate to the load on the pump, and the processor can compare the load on the pump to detect when fluid absent of any solids is being pumped through the system, thereby, indicating that all debris in the area has been collected.

An example method of debris collection includes fluidizing debris in a wellbore. The debris can be fluidized by circulating fluid using the pump section. The circulating fluid can fluidize the debris. The method also includes flowing the fluidized fluid through a velocity tube, and discharging the fluidized debris to a storage space formed between the velocity tube and a storage housing. The discharging can be through a hole formed in the velocity tube, an outlet of the velocity tube, or combinations thereof. The method can also include separating solids from the fluidized debris and storing the solids in the storage space. The method can also include preventing solids in the storage space from entering the velocity tube via the hole formed in the velocity tube.

Figure 1:
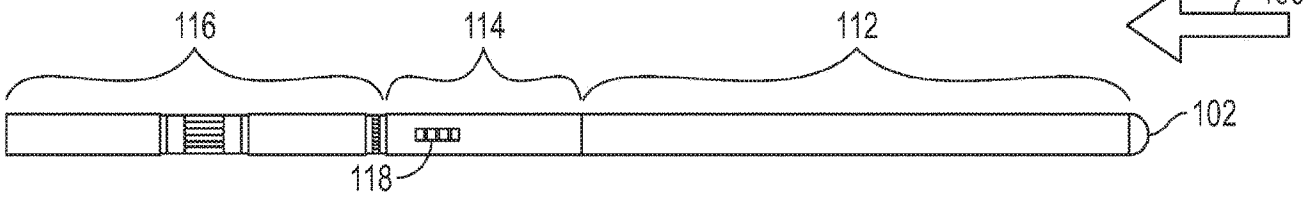
FIG. 1 depicts an embodiment of a system for debris removal.

Turning now to the Figures. FIG. 1 depicts an embodiment of a system for debris removal. The system 100 includes a nozzle assembly 102. The system 100 includes a debris storage section 112, a pump section 114, and a power section 116. The pump section 114 can have discharge ports 118.

Figure 2:
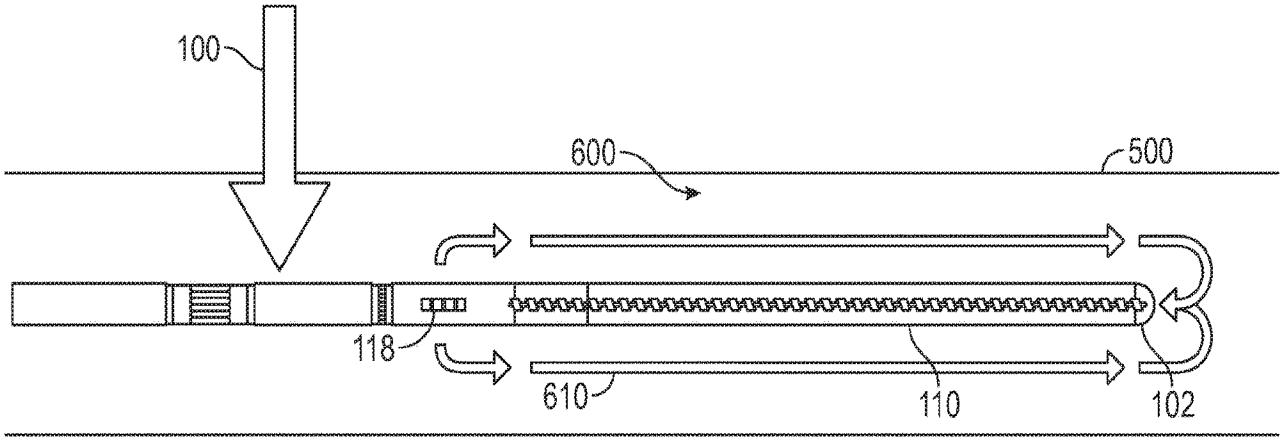
FIG. 2 depicts an example of a flow path generated by the system for debris removal.

FIG. 2 depicts an example of a flow path generated by the system for debris removal. The system for debris removal 100 can be located in a well 500. An annulus 600 can be formed between the system 100 and the well 500. To perform the debris removal operation, fluid 610 is discharged from discharge ports 118. The fluid 610 traverses the annulus 600 and collects debris in the annulus 600. The fluid 610 and collected debris are drawn through the nozzle 102 to the debris storage section 110. The debris storage section 110 removes the debris from the fluid 610, and the fluid 610 can then be circulated back through the discharge ports 118 to the annulus to collect additional debris.

Figure 3:
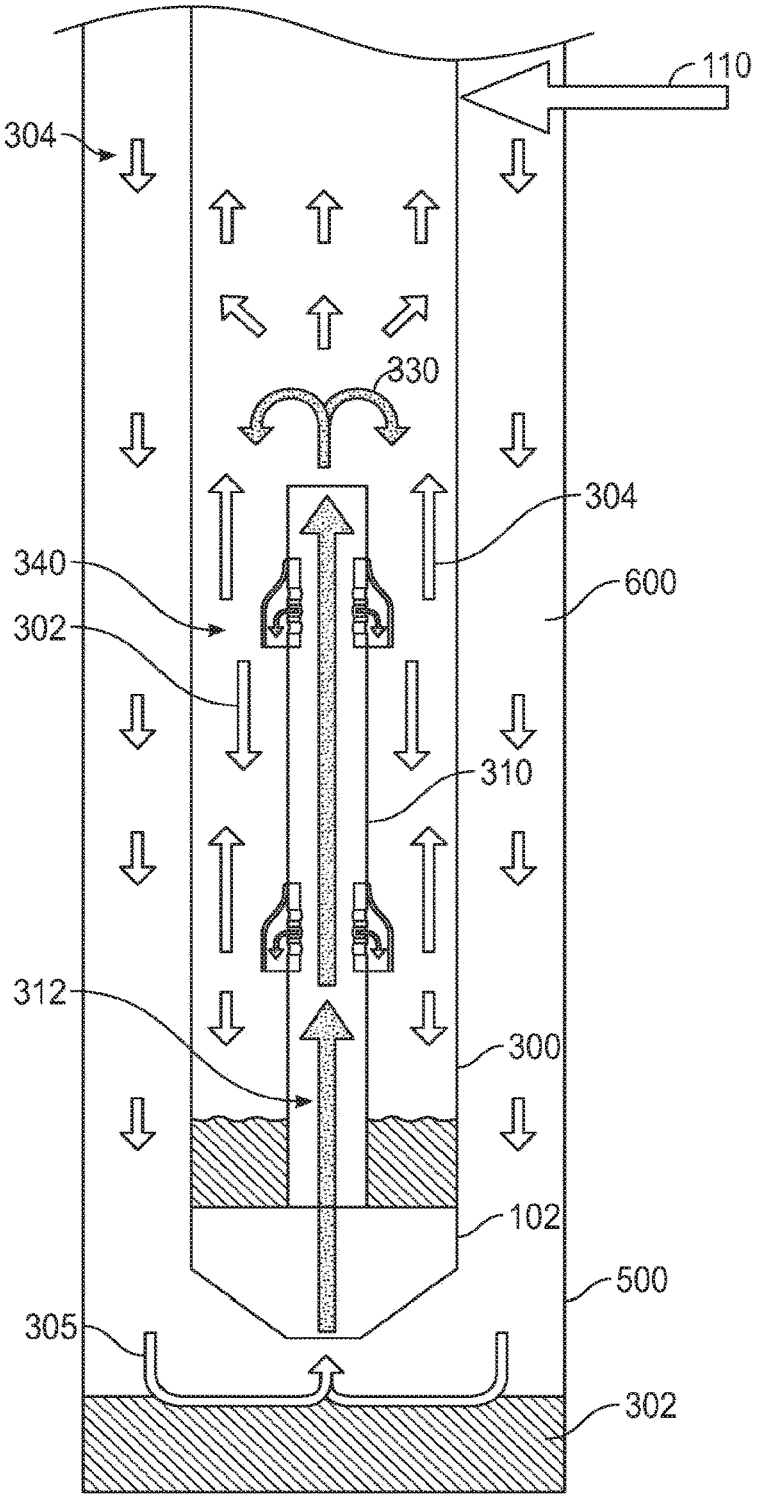
FIG. 3 depicts a schematic of an example storage section.
Figure 4:
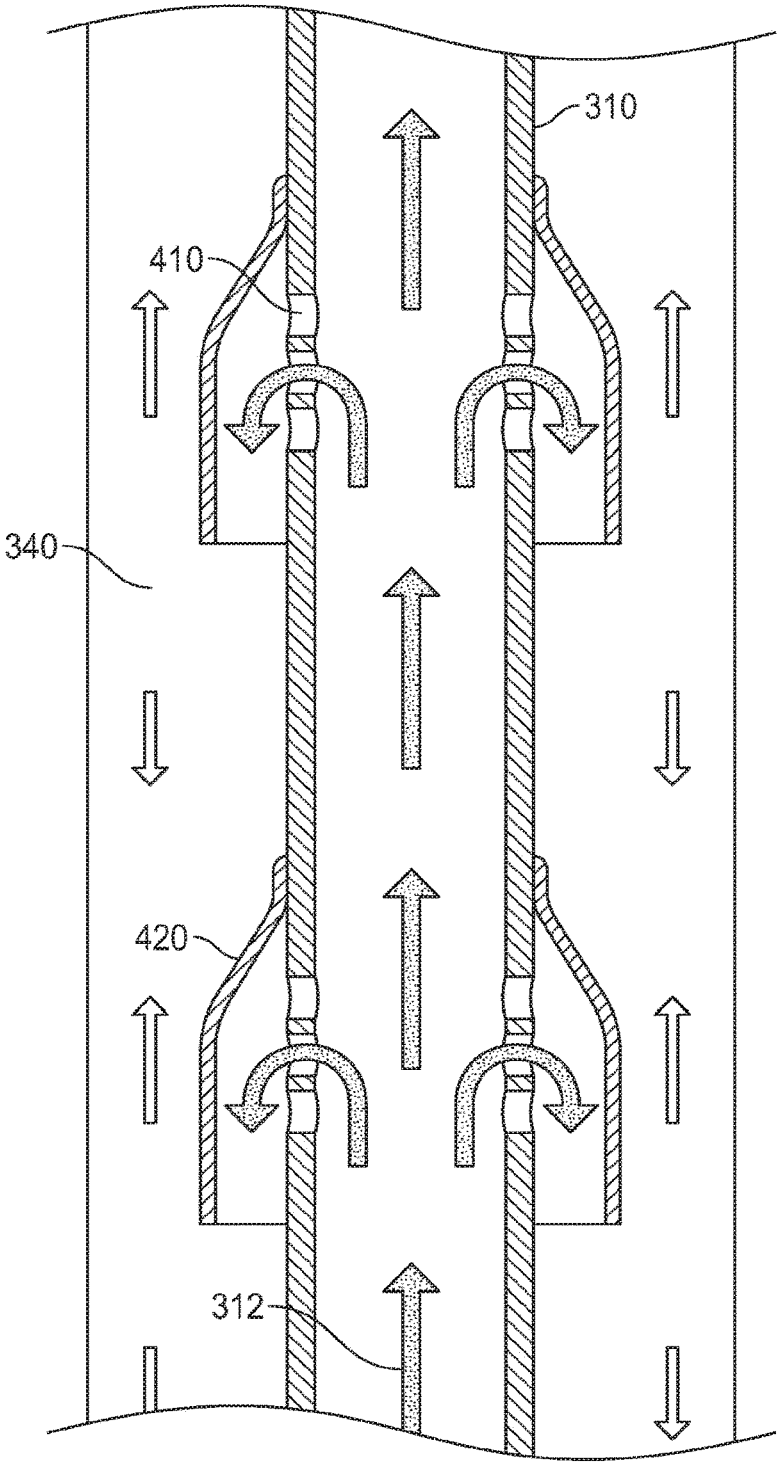
FIG. 4 depicts a portion of a velocity tube.

FIG. 3 depicts a schematic of an example storage section. FIG. 4 depicts a portion of a velocity tube. Referring to FIG. 3 and FIG. 4, the debris storage section 110 is located in the well 500 adjacent debris 302. Fluid 304 is circulated in the annulus 600 and fluidizes the debris 302 forming a fluidized debris 305. The fluidized debris 305 flows into the nozzle 102. The fluidized debris 305 is formed into a high velocity stream 312 and traverses a velocity tube 310. At least a portion of the fluidized debris can exit the velocity tube 310 into a storage space 340 formed between the velocity tube 310 and the debris storage housing 300. The fluidized debris exiting the velocity tube 310 via the holes 410 can separate into debris 302 and fluid 304 in the storage space 340. Another portion of the fluidized debris can exit an outlet of the velocity tube as indicated at 330; the fluidized debris exiting the outlet of the velocity tube can separate into fluid and debris. The fluid 304 can be circulated back to the annulus 600 and the debris 302 to can be stored in the storage housing 300.

Deflectors 420 are located on the velocity tube 310 adjacent the holes 410. The deflectors 420 prevent debris in the storage housing 300 from entering the velocity tube 310 via holes 410.

Figure 5:
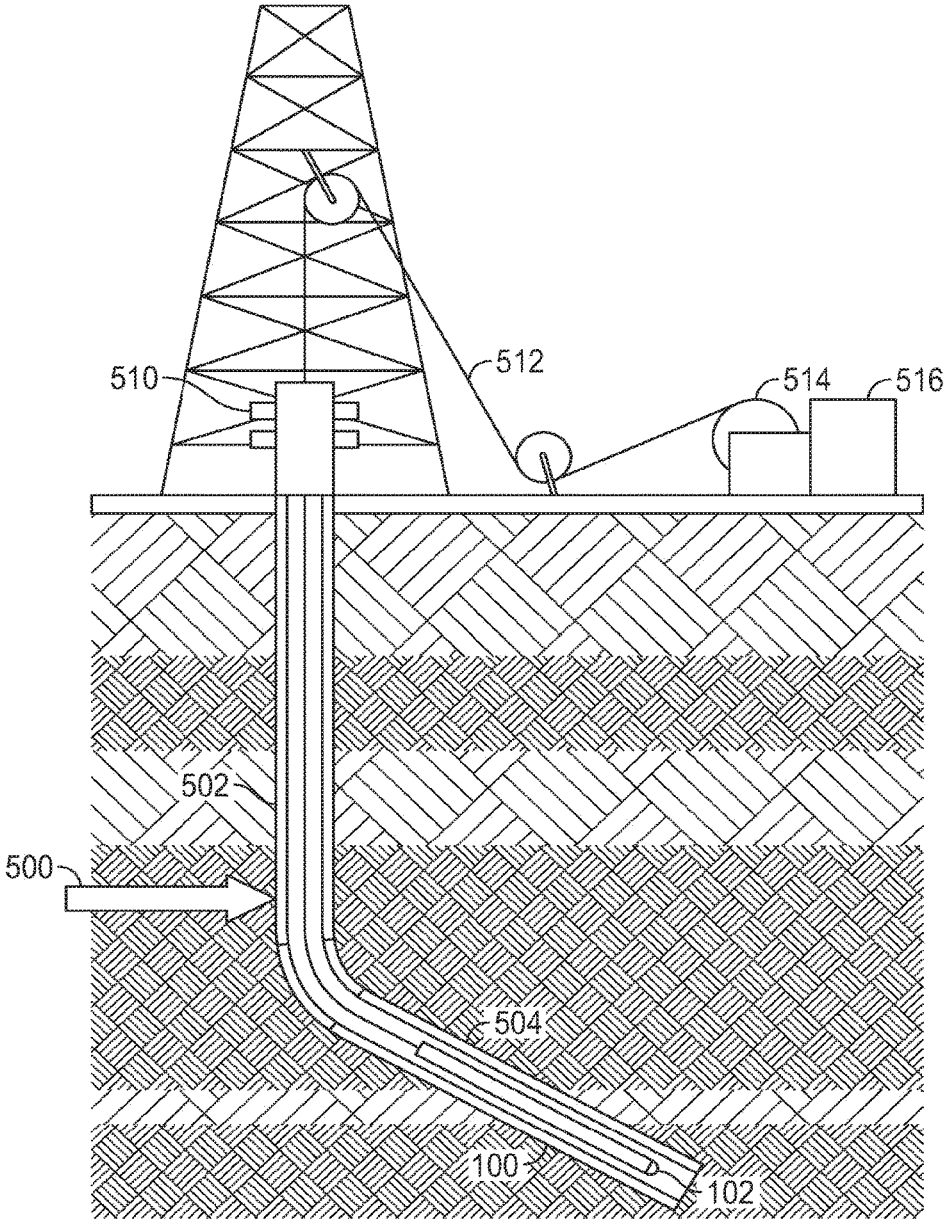
FIG. 5 depicts an embodiment of a system for debris removal located in a well.

FIG. 5 depicts an embodiment of a system for debris removal located in a well.

The system 100 can be connected with a wireline 512. The wireline 512 is operatively connected with a winch 514 and a control unit 516. A derrick 510 supports the wireline 512. The wireline 512 is used to move the system 100 into the well 500. The well 500 can have a vertical section 502 and a deviated section 504. The system 100 can be moved within the well 500. The system 100 can be positioned in the deviated section 504 to perform a debris removal operation, and the nozzle assembly 102 allows the nozzle end to be oriented in a proper position relative to the well 500.

Although example assemblies, methods, systems have been described herein, the scope of coverage of this patent is not limited thereto. On the contrary, this patent covers every method, nozzle assembly, and article of manufacture fairly falling within the scope of the appended claims either literally or under the doctrine of equivalents.

What is claimed is:

1. An apparatus for debris collection comprising:

a debris storage housing;

a velocity tube located within the debris storage housing;

a storage space radially formed between the velocity tube and the debris storage housing;

a first hole formed through a side of the velocity tube, wherein the first hole is in fluid communication with an inner flow path of the velocity tube in a first axial direction; and a first deflector located on an exterior side of the velocity tube adjacent the first hole, wherein the first deflector is positioned on the exterior side in the storage space to prevent a flow in a second axial direction through the storage space from entering into the inner flow path, wherein the second axial direction is opposite the first axial direction, and wherein the first deflector encircles the first hole.

2. The apparatus of claim 1, wherein a nozzle is located adjacent an inlet to the velocity tube.

3. The apparatus of claim 2, wherein the velocity tube comprises an outlet opposite the inlet, wherein the first hole and the first deflector are axially disposed between the outlet and the inlet.

4. The apparatus of claim 1, wherein the debris storage housing is connected with a pump section, wherein the pump section comprises a pump housing.

5. The apparatus of claim 4, further comprising a discharge port formed through the pump housing.

6. The apparatus of claim 4, further comprising a power section connected with the pump section.

7. The apparatus of claim 1, comprising a second hole formed through the side of the velocity tube, wherein the second hole is disposed axially upstream of the first hole relative to the inner flow path through the velocity tube.

8. The apparatus of claim 7, comprising a second deflector located on the exterior side of the velocity tube adjacent the second hole, wherein the second deflector is positioned on the exterior side in the storage space to prevent the flow in the second axial direction through the storage space from entering into the inner flow path, wherein the second deflector encircles the second hole, and wherein the second deflector is disposed axially upstream of the first deflector relative to the inner flow path through the velocity tube.

9. The apparatus of claim 7, wherein the first deflector is radially positioned in the storage space between the second hole and the debris storage housing to prevent the flow in the second axial direction through the storage space from entering into the inner flow path.

10. A method of debris collection, wherein the method comprises:

fluidizing debris in a wellbore;

flowing the fluidized debris through a velocity tube in a first axial direction;

discharging the fluidized debris to a storage space radially formed between the velocity tube and a storage housing, wherein the discharging is through a first hole formed in a side of the velocity tube and an outlet of the velocity tube;

separating solids from the fluidized debris and storing the solids in the storage space; and preventing the solids in the storage space from entering the velocity tube via the first hole formed in the side of the velocity tube using a first deflector adjacent to the first hole, wherein the first deflector is located on an exterior of the velocity tube in the storage space and is radially positioned in the storage space between the first hole and the storage housing.

11. The method of claim 10, wherein fluidizing debris comprises circulating fluid.

12. The method of claim 10, comprising discharging the fluidized debris to the storage space through a plurality of holes formed in the side of the velocity tube and the outlet of the velocity tube, wherein the plurality of holes comprises the first hole disposed at a first axial position relative to the outlet, and the plurality of holes comprises a second hole disposed at a second axial position relative to the outlet.

13. The method of claim 12, comprising preventing the solids in the storage space from entering the velocity tube via the first hole or the second hole using the first deflector adjacent the first hole and the second hole, wherein the first deflector is radially positioned in the storage space between the second hole and the storage housing.

14. The method of claim 12, comprising preventing the solids in the storage space from entering the velocity tube via the second hole using a second deflector adjacent the second hole, wherein the second deflector is located on the exterior of the velocity tube in the storage space, the second deflector is radially positioned in the storage space between the second hole and the storage housing.

15. A system for debris collection, wherein the system comprises:

a power section;

a pump section connected with the power section;

a debris storage section connected with the pump section, wherein the debris storage section comprises:

a debris storage housing;

a velocity tube located within the debris storage housing;

a storage space radially formed between the velocity tube and the debris storage housing;

a first hole formed through a side of the velocity tube, wherein the first hole is in fluid communication with an inner flow path of the velocity tube; and a first deflector located on an exterior side of the velocity tube adjacent the first hole, wherein the first deflector is positioned on the exterior side in the storage space, wherein the first deflector encircles the first hole.

16. The system of claim 15, wherein a nozzle is located adjacent an inlet to the velocity tube.

17. The system of claim 15, further comprising a discharge port formed through the pump section.

18. The system of claim 15, wherein the debris storage section comprises a second hole formed through the side of the velocity tube, wherein the second hole is disposed axially upstream of the first hole relative to the inner flow path through the velocity tube.

19. The system of claim 18, comprising a second deflector located on the exterior side of the velocity tube adjacent the second hole, wherein the second deflector is positioned on the exterior side in the storage space, wherein the second deflector encircles the second hole, and the second deflector is disposed axially upstream of the first deflector relative to the inner flow path through the velocity tube.

20. The system of claim 18, wherein the first deflector is radially positioned in the storage space between the second hole and the debris storage housing to prevent a flow through the storage space from entering into the inner flow path, wherein the flow is directed in an axial direction away from the pump section.

* * * * *